US009498693B1

(12) United States Patent
Kraus et al.

(10) Patent No.: US 9,498,693 B1
(45) Date of Patent: Nov. 22, 2016

(54) APPARATUS AND METHOD FOR ATHLETIC TRAINING

(71) Applicants: Jeffrey L. Kraus, Racine, WI (US); Lawrence E. Kraus, Racine, WI (US); C Michael Oertel, Racine, WI (US); James Orrico, Chicago, IL (US)

(72) Inventors: Jeffrey L. Kraus, Racine, WI (US); Lawrence E. Kraus, Racine, WI (US); C Michael Oertel, Racine, WI (US); James Orrico, Chicago, IL (US)

(73) Assignee: Krausko, LLC, Racine, WI (US)

( * ) Notice: Subject to any disclaimer, the term of this patent is extended or adjusted under 35 U.S.C. 154(b) by 6 days.

(21) Appl. No.: 14/216,558

(22) Filed: Mar. 17, 2014

Related U.S. Application Data

(63) Continuation-in-part of application No. 13/705,662, filed on Dec. 5, 2012, now abandoned.

(51) Int. Cl.
*A63B 69/34* (2006.01)
*A63B 69/00* (2006.01)
*A63B 69/20* (2006.01)

(52) U.S. Cl.
CPC ..... *A63B 69/345* (2013.01); *A63B 69/0002* (2013.01); *A63B 69/20* (2013.01); *A63B 2243/007* (2013.01)

(58) Field of Classification Search
CPC .. A63B 69/004; A63B 69/201; A63B 63/06; A63B 69/002; A63B 69/345; A63B 69/0071; A63B 69/0095; A63B 69/34; A63B 69/0091; A63H 11/10; A63H 30/04
USPC ..... 473/438, 422, 442, 443, 444, 445, 439, 473/441; D21/698, 635; 482/83, 87, 90
See application file for complete search history.

(56) References Cited

U.S. PATENT DOCUMENTS

| | | | | | |
|---|---|---|---|---|---|
| 604,243 | A | * | 5/1898 | Verpillier | A63H 3/46 446/375 |
| 2,129,421 | A | * | 9/1938 | Hales | A63H 3/04 446/375 |
| 2,162,073 | A | | 6/1939 | Evans | |
| 2,526,217 | A | | 10/1950 | Gilman | |
| 2,574,046 | A | | 11/1951 | Logan | |
| 2,909,370 | A | * | 10/1959 | Fortney | 482/83 |
| 3,357,610 | A | * | 12/1967 | Quinby, Jr. | A63H 3/04 446/375 |
| 3,391,936 | A | * | 7/1968 | Grimes | 473/439 |
| 3,558,135 | A | | 1/1971 | Rees | |
| 3,573,867 | A | * | 4/1971 | Mehrens | 473/439 |
| 3,680,861 | A | | 8/1972 | Schmidt | |
| 3,700,237 | A | | 10/1972 | Kopp | |
| 3,804,406 | A | * | 4/1974 | Viscione | 482/4 |
| 3,827,690 | A | | 8/1974 | Rogers | |
| 3,888,481 | A | * | 6/1975 | Adams et al. | 482/128 |
| 3,997,160 | A | | 12/1976 | George | |
| 4,387,892 | A | * | 6/1983 | Wen | 482/83 |

(Continued)

OTHER PUBLICATIONS

Pages 14, 40 and 41 from a 2013 Rogers Athletic Catalog (3 pages total, enclosed herewith).

*Primary Examiner* — Mitra Aryanpour
(74) *Attorney, Agent, or Firm* — Boyle Fredrickson, S.C.

(57) ABSTRACT

An apparatus and method used for athletic training wherein movable arms are interconnected with a frame structure. A coil spring is used to reposition the arms to an original position. The arms and frame are typically comprised of a padded surface. The frame can be composed of a tubular structure to which the arms and head are releasably interconnected in multiple orientations. A target jersey with shoulder pads can be positioned over the frame to better simulate American football exercises.

5 Claims, 22 Drawing Sheets

(56) References Cited

U.S. PATENT DOCUMENTS

| | | | | | |
|---|---|---|---|---|---|
| 4,564,192 | A * | 1/1986 | Lebowitz | A63B 69/004 | 482/87 |
| 4,667,954 | A | 5/1987 | McCorkle | | |
| 4,688,792 | A | 8/1987 | Rivkin | | |
| 4,749,184 | A * | 6/1988 | Tobin | 482/87 | |
| 4,824,414 | A | 4/1989 | Goldblatt | | |
| 4,869,503 | A | 9/1989 | Grasso | | |
| 4,934,938 | A | 6/1990 | Orlandi | | |
| 4,946,159 | A | 8/1990 | Jones | | |
| 4,989,862 | A * | 2/1991 | Curtis | 473/448 | |
| 5,090,696 | A | 2/1992 | Forrest, Sr. | | |
| 5,280,905 | A | 1/1994 | Micco | | |
| 5,335,906 | A | 8/1994 | Delker | | |
| 5,385,523 | A | 1/1995 | Forrest | | |
| 5,984,809 | A | 11/1999 | Hadar | | |
| 6,063,011 | A * | 5/2000 | Pelchat | 482/83 | |
| 6,261,194 | B1 | 7/2001 | Hadar | | |
| 6,302,831 | B1 * | 10/2001 | Henry | 482/83 | |
| 6,599,206 | B1 | 7/2003 | Forrest, Sr. | | |
| 6,685,581 | B2 | 2/2004 | Krause | | |
| 6,761,650 | B1 | 7/2004 | Dettmann | | |
| 6,824,504 | B2 | 11/2004 | Ott | | |
| 6,942,585 | B1 | 9/2005 | Krause | | |
| 6,988,965 | B2 | 1/2006 | Krause | | |
| 7,056,238 | B1 | 6/2006 | Brown | | |
| 7,070,521 | B2 | 7/2006 | Bayduke | | |
| 7,131,917 | B2 | 11/2006 | Spencer | | |
| 7,147,579 | B2 | 12/2006 | Forrest | | |
| 7,357,760 | B1 | 4/2008 | Rios | | |
| 7,491,139 | B2 | 2/2009 | Bridge | | |
| 7,497,792 | B2 | 3/2009 | Hutton | | |
| 7,527,568 | B2 | 5/2009 | Joseph | | |
| 7,794,337 | B2 | 9/2010 | Gamboa | | |
| 7,828,701 | B1 * | 11/2010 | Chen | A63B 69/004 | 482/83 |
| 7,998,035 | B2 * | 8/2011 | Chen | 482/83 | |
| 8,439,809 | B2 * | 5/2013 | Machado | A63B 69/004 | 482/83 |
| 8,617,034 | B2 * | 12/2013 | Eem | A63B 69/203 | 482/83 |
| 8,708,868 | B2 * | 4/2014 | Partlo | A63B 69/34 | 482/84 |
| 8,777,818 | B1 * | 7/2014 | Tate, Jr. | A63B 69/004 | 482/83 |
| D731,012 | S * | 6/2015 | Gilman | D21/698 | |
| 9,050,514 | B1 * | 6/2015 | Mirza | A63B 69/004 | 482/83 |
| 9,254,429 | B1 * | 2/2016 | Gilman | A63B 69/34 | 473/445 |
| 2002/0077226 | A1 | 6/2002 | Ott | | |
| 2002/0147061 | A1 | 10/2002 | Krause | | |
| 2002/0193211 | A1 * | 12/2002 | Kao | A63B 69/34 | 482/83 |
| 2006/0100040 | A1 | 5/2006 | Spencer | | |
| 2007/0225089 | A1 * | 9/2007 | Jones | A63B 69/34 | 473/447 |
| 2008/0015093 | A1 * | 1/2008 | Helton | A63B 69/345 | 482/83 |
| 2008/0058128 | A1 | 3/2008 | Joseph | | |
| 2009/0088302 | A1 * | 4/2009 | Brenner | A63B 69/34 | 482/87 |
| 2009/0264262 | A1 * | 10/2009 | Brenner | A63B 69/34 | 482/83 |
| 2011/0256990 | A1 * | 10/2011 | Machado | A63B 69/004 | 482/83 |
| 2013/0137554 | A1 * | 5/2013 | Knight | A63B 69/345 | 482/85 |

* cited by examiner

5A

APPARATUS AND METHOD FOR ATHLETIC TRAINING

CROSS-REFERENCES TO RELATED APPLICATIONS

The present application is a continuation-in-part of U.S. patent application Ser. No. 13/705,662 filed on Dec. 5, 2012 entitled "Apparatus And Method For Athletic Training," which is incorporated by reference into this application.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

BACKGROUND OF THE INVENTION

Field of the Invention

The present invention relates to an athletic training apparatus. More specifically, the invention relates to a training apparatus for any sport that requires "arm to arm" contact and mobility, and particularly to an apparatus and method for training an American football player or athlete training for another contact sport such as rugby, mixed martial arts (MMA), basketball, soccer or wrestling. The invention can also be used in conjunction with a physical therapy program or law enforcement training.

BRIEF SUMMARY OF THE INVENTION

Contact sports such as American football, rugby or MMA often require the use of tackling dummies, striking pads and blocking pads during practice to reduce the likelihood of injuries resulting from player-to-player or player-to-coach contact during practice and during off-season indoor or outdoor training. Conventional blocking pads and dummies are somewhat limited in the skills that can be taught using such pads and dummies. Conventional blocking pads and dummies are generally designed for maximum versatility, which typically makes such devices less suited for certain American football offensive linemen, offensive backs and receivers, defensive linemen, linebackers and defensive backs where "arm to arm" or "hand to hand" interaction is critical. While conventional pads and dummies are used to train offensive and defensive linemen in American football, such conventional pads and dummies typically lack the mobility and arm structure to adequately simulate the actions of their opposing linemen. For example, typical cylinder dummies or hand held pads and shields offer no arms to reasonably simulate an opponent's physical resistance and arm reaction, nor do they simulate the spatial integrity of the contact. Sled-mounted dummies lack any mobility and, therefore, are severely limited in simulating human movement. Conventional cylinder dummies lack mobility and, at best, provide only hook and loop attached arms that provide little, if any, resistance and do not simulate human opponents. While these devices may be useful for strength training, they do nothing to improve critical "arm to arm" and "hand to hand" techniques that are required for athletes to excel.

The present invention overcomes the limitations of the prior art by including a frame structure with spring mounted arms in a light weight blocking pad or molded dummy that simulates the independent arm action and other movements of an opposing contact sport player as well as offering new structures and functionality. Because this invention is light weight and can be hand-held, the resulting training device safely combines human-like arm action and the mobility of the instructor/coach/player positioning the device. The realistic arms provide unique spatial integrity and target points such as elbows and arm pits. The realistic arms also allow coaches to control pad level when practicing both blocking and tackling. This combination of realistic arm action and mobility allows the device to be used in the training exercises necessary for coaching or for instructing American football, MMA, basketball, soccer, rugby, law enforcement techniques and for use in physical therapy programs. This device also allows the coach to safely control movement, pad level or arm level and the level of aggression up to 100 percent during practice. As a result, athletes can improve technique, as well as physical strength and muscle memory, while safely simulating live situations at full speed. The device provides "arm to arm" physical training without repeated blows and pain to the receiving party, allowing the instructor to view and train proper technique. The dimensions of the device and the strength of the arm springs can be adapted to provide meaningful resistance throughout the range of movement enabling the device to be produced in youth, high school and adult sizes to provide training devices for both male and female athletes of all sizes.

In one aspect, the present invention includes a flat or an optional tubular frame that is embedded in an open-cell or closed-cell foam pad that is covered with a durable, protective material (e.g., vinyl, fabric, urethane or vinyl coating or other similar materials) and these exterior surfaces can also be molded to more accurately simulate the human body. The outer cover of the present invention also can include handles to allow a coach or instructor to properly position the light weight device. The rigid portions of the invention can be constructed from solid or tubular steel, aluminum, FIBERGLAS, a glass fiber reinforced plastic material, plastic, composites or other similar materials. The arms can be straight or slightly bent toward the center to better simulate a human opponent. The rigid portion of the arm can be constructed from steel, aluminum, plastic, FIBERGLAS, a glass fiber reinforced plastic material, composites or other materials. The rigid arms can be covered by open-cell or closed-cell cylindrical foam pad and covered with a durable, protective material (vinyl, fabric, urethane or vinyl coating or other similar materials) and these materials can also be molded to more accurately simulate the human body. This device also can include an arm/spring combination that is formed from a single piece of material that would be attached to the frame using the "stress relief pin" technique. This same fabrication approach can be used to form an arm with both simulated shoulder and elbow joints as well as a wrist joint.

In the "flat frame" version of the present invention, the springs for the spring arms are attached (typically using a silicone/bronze weld or equivalent) at right angles to the flat frame around the "stress relief pin," The "stress relief pin" limits the amount of spring deflection and minimizes the amount of stress on the welds holding the springs to the frame by distributing the force along the active coils of the spring. In the case where an arm rod is attached to the other end of the spring, the solid arm piece is inserted into the coil spring to provide a "stress relief pin" at that spring weld point. This mounting technique significantly increases device life.

In the "tubular frame" version of the present invention, the rigid frame is comprised of three square tubes, a vertical "spine tube" welded at right angles to a horizontal "shoulder tube" and a "waist tube" also welded at right angles to the "spine tube" and parallel to the "shoulder tube". The ends of these tubes provide openings for rectangular plugs to be inserted and secured. The spring ends for the arms, optional head and mounting devices are welded to the removable, rectangular plugs and these plugs can be inserted and secured independently in any orientation. Springs are welded to the rectangular plugs using the same "stress relief pin" concepts discussed above.

Using the tubular frame version of the invention, a spring mounted head plug can be inserted and secured in the top of the "spine tube" and the left and right arm plugs can be inserted in the ends of the "shoulder tube" in any chosen orientation, e.g. both up, both forward, both down, both backward, or one up and one down, one forward and one up, etc. The rectangular plugs can also be formed to have the springs mounted at 45 degree angles, increasing the arm orientations to eight possible positions. The Tubular Frame also provides an opening at the bottom of the "spine tube" to allow the insertion of a support mechanism when an instructor needs to hold the training device away from his body, e.g., when training head or body kicks during MMA instruction. The support device can also be a mono-pole with a foot, spike or caster base depending on the desired mobility. With the addition of the appropriate mounting hardware the device may also be mounted to walls, football sleds, cylinder dummies or other specific purpose training apparatus.

In another aspect, to further increase the realism of the training, the present invention can include the ability to magnetically attach training aids to the arms, e.g., a football, a weapon, MMA devices, etc. The present invention can also provide a football target jersey with integral shoulder pads for use in the advanced training of hand placement and how offensive linemen should engage their opponent. The targets on the jersey are preferred hand placement for offensive blockers, and the shoulder pads provide "legal grab points" for all offensive and defensive players. The target jersey further simulates the actual feel the player will encounter in game conditions. With the target jersey/shoulder pads mounted on the device, the arms function normally.

BRIEF DESCRIPTION OF THE SEVERAL VIEWS OF THE DRAWINGS

FIGS. 5A and 5B are views of a stress relief pin.

The drawings are shown for illustrative purposes only and are not intended to limit the scope of the claimed invention.

DETAILED DESCRIPTION OF THE INVENTION

Figure 1:
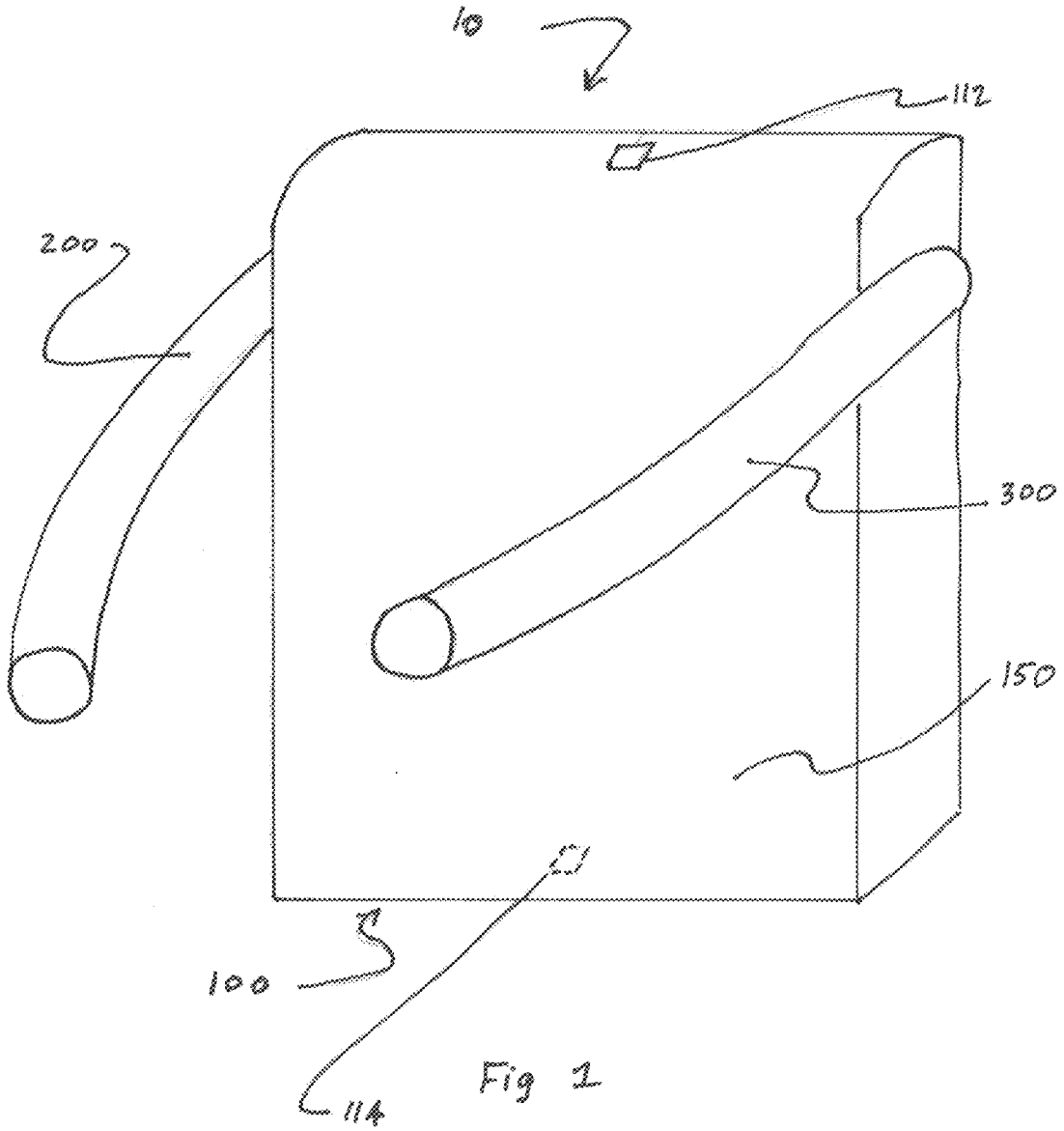
FIG. 1 is a front perspective view of a blocking pad.

Referring to FIG. 1, a front perspective view of a blocking pad 10 according to one aspect of the present invention is shown. Blocking pad 10 includes a main body 100, a first arm 200, and a second arm 300. Main body 100 typically includes a pad 150, which in one aspect of the invention is an approximately four inch thick vinyl covered foam pad. The pad can also be formed from molded foam with an integral skin covering. In another aspect of the invention, body 100 can include openings 112 and 114 to receive ends 6260 and 6280 of spine tube 6200 (see FIG. 9A). As explained herein, arms 200 and 300 can move independently in any direction and when released will return to their original position.

Figure 2:
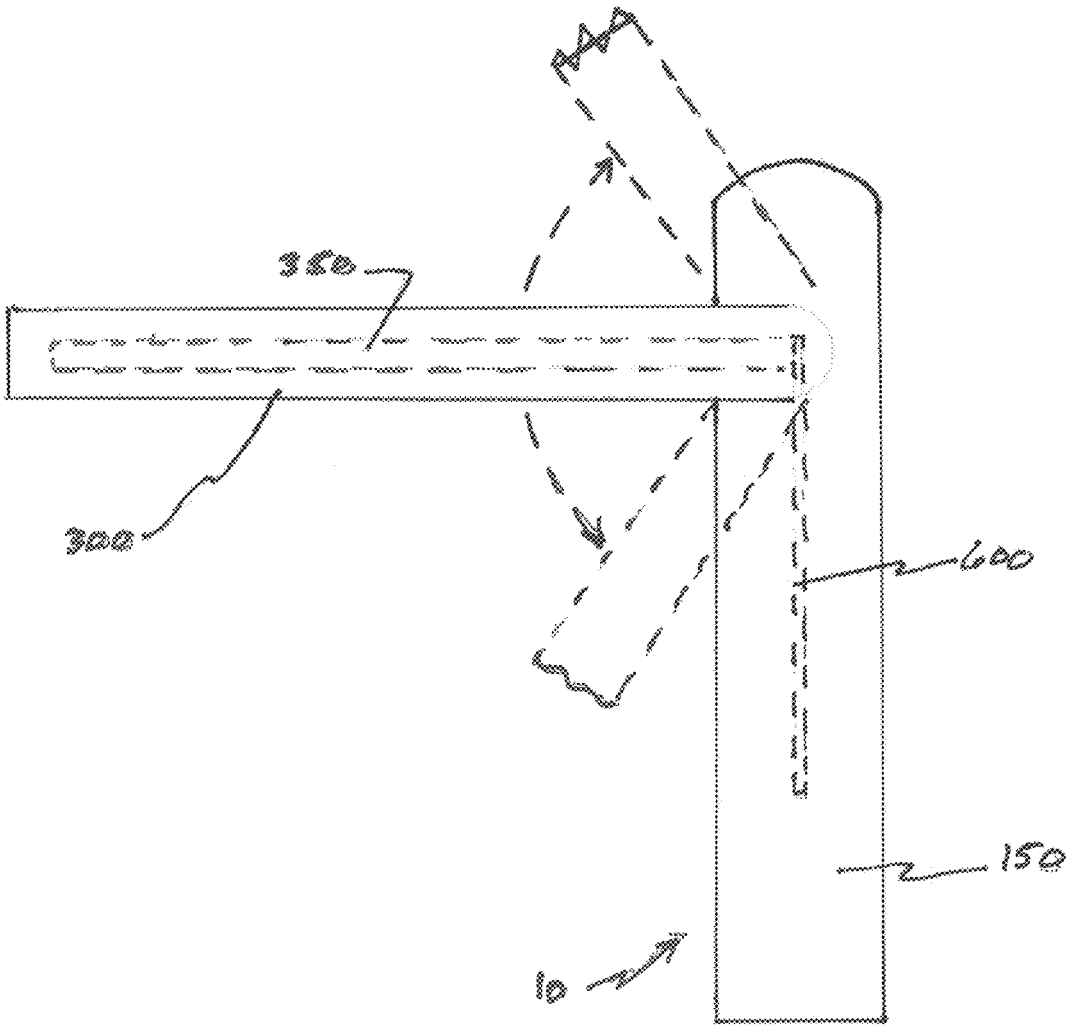
FIG. 2 is a side elevation view of a blocking pad.

FIG. 2 is a side elevation view of the blocking pad 10 which includes a main body 150 and a second arm 300. An arm stiffener 350 is shown embedded within the second arm 300. Arm 300 typically includes two inch thick vinyl covered foam tubing, and arm stiffener 350 is typically used to provide rigidity and strength to arm 300. The arm stiffener may also be molded into a foam arm with an integral skin covering. Arm 300 can move up and down as well as right to left and will return to its initial unrestrained position when released. The arm spring (not shown) is attached to a horizontal support member in the frame 600.

Figure 3:
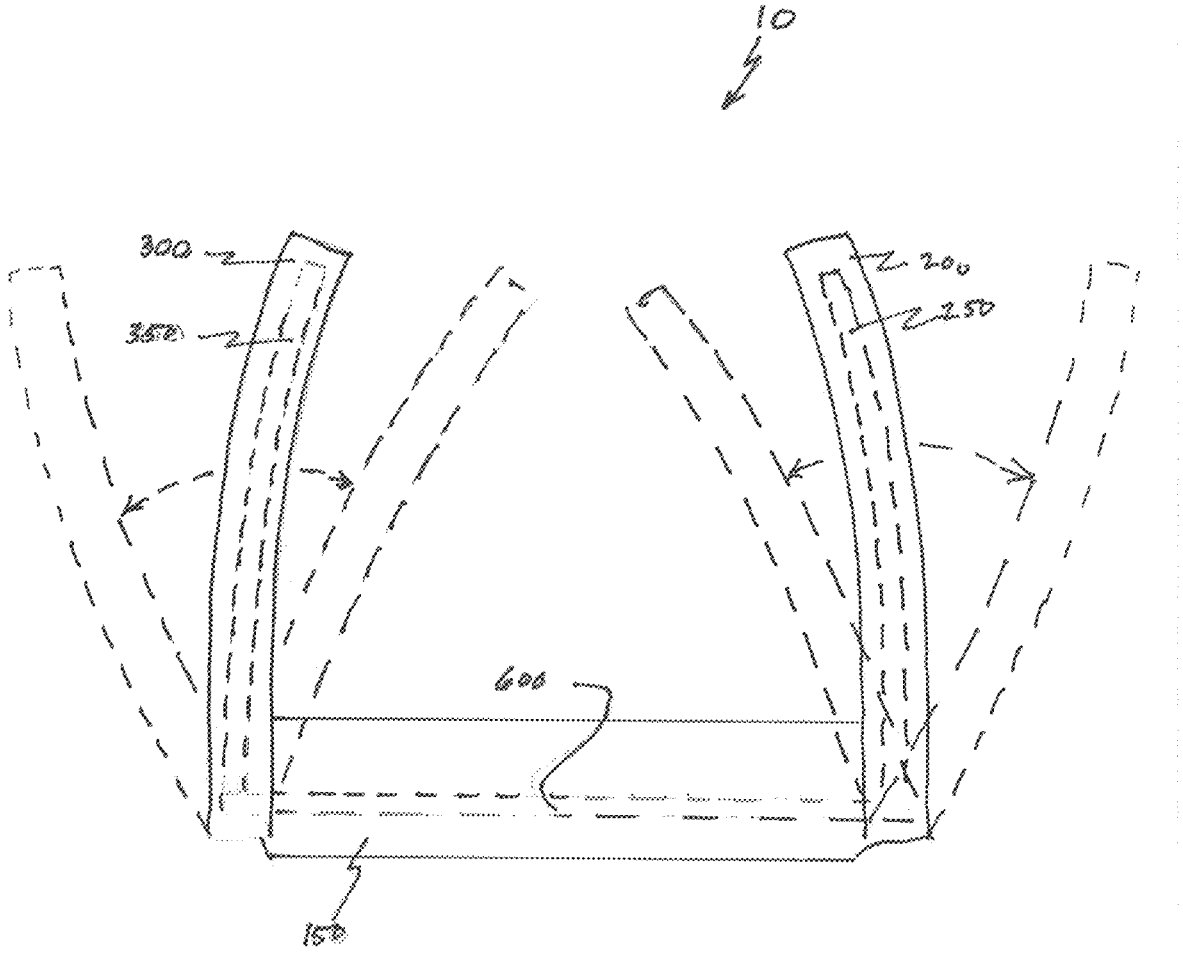
FIG. 3 is a top plan view of a blocking pad.

FIG. 3 is a top plan view of the blocking pad 10 according to another aspect of the invention. A horizontal support bar 600 (e.g., a frame) is typically used to support arms 200 and 300 according to one aspect of the invention. The arms 200 and 300 can move horizontally as indicated and vertically and will return to their original unrestrained position when released.

Figure 4:
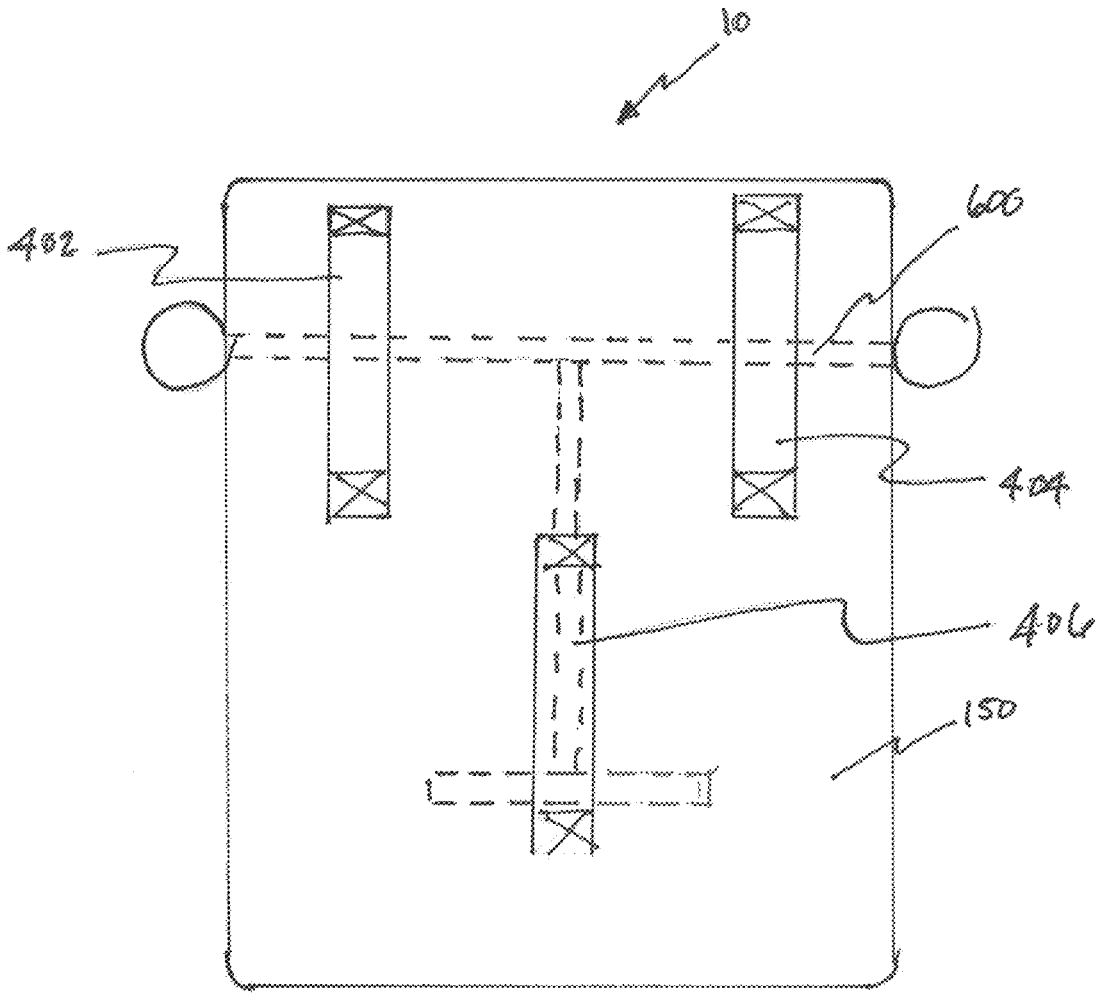
FIG. 4 is a rear elevation view of a blocking pad.

FIG. 4 is a rear elevation view of the blocking pad 10 according to one aspect of the invention. Here, three handles 402, 404, and 406 can be attached to the cover of pad 150 to allow an instructor to properly position and hold the device.

Figure 5B:
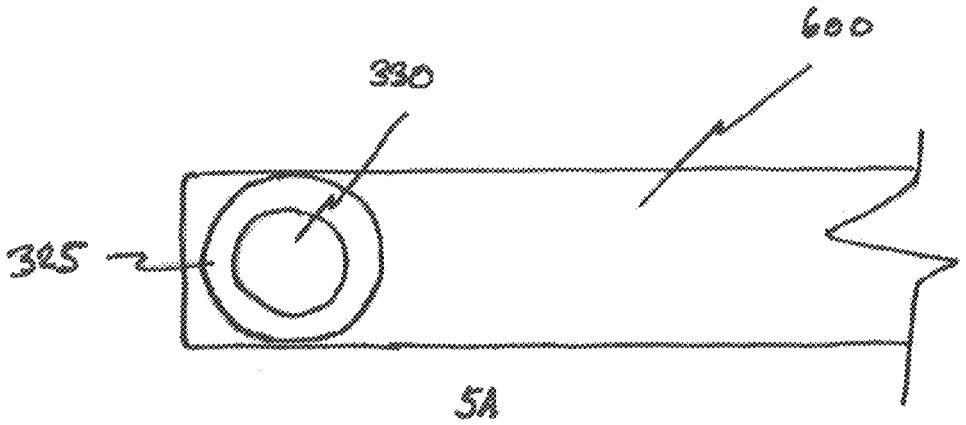
Figure 5B:
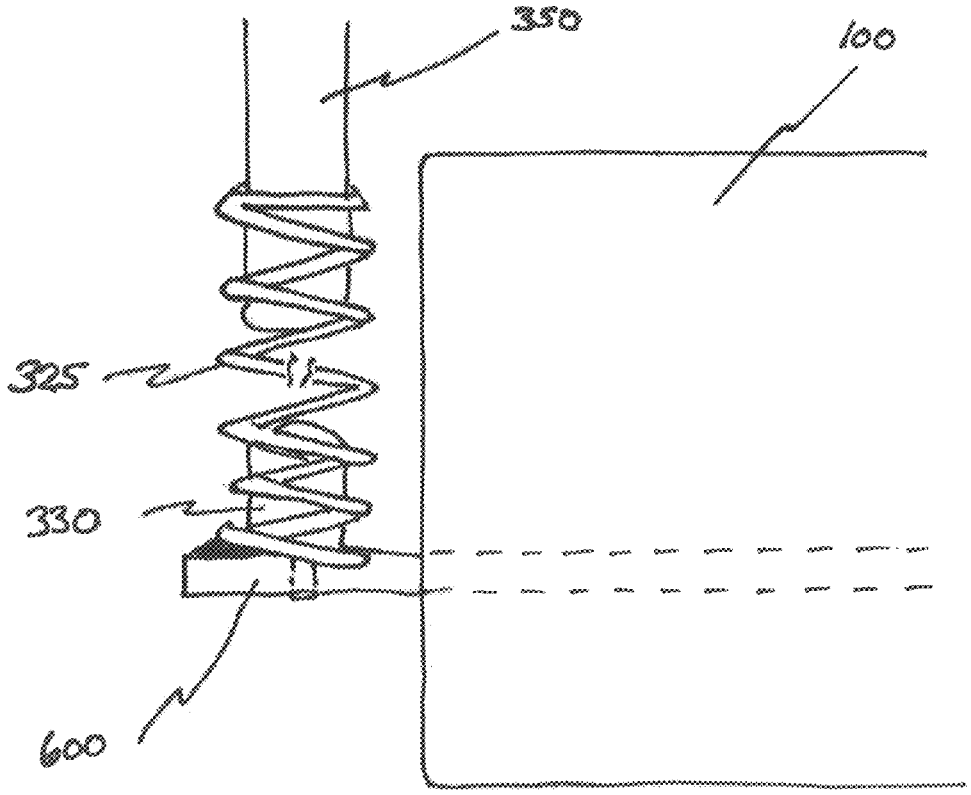

FIG. 5B is a top plan view of a stress relief pin 330, also shown in FIG. 5A, and the spring 325 typically mounted or otherwise interconnected to the frame 600 and to the arm stiffener 350. The stress relief pin 330 can be welded to the frame 600 at the rear of the guide pin. The stress relief pin 330 can be approximately 25 percent of the length of the spring 325. Alternatively, any other suitable length for reducing the stress on spring 325 can be used. The spring is typically welded to the frame 600 using a silicone/bronze welding/brazing method. The arm stiffener 350 is typically inserted approximately 25 percent of the length of the spring 325 and welded/brazed. The same process is used for arm stiffener 250 (not shown).

Figure 6B:
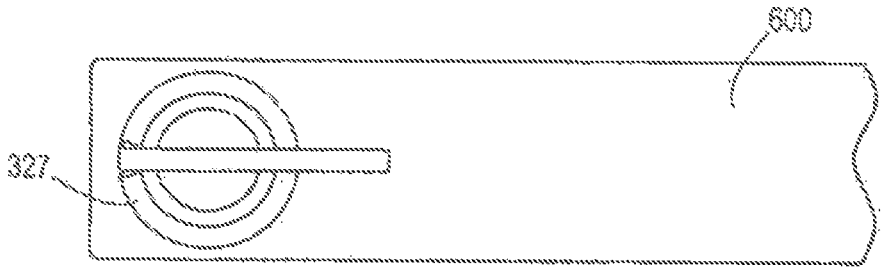
FIGS. 6A and 6B are views of a one piece spring/arm.
Figure 6A:
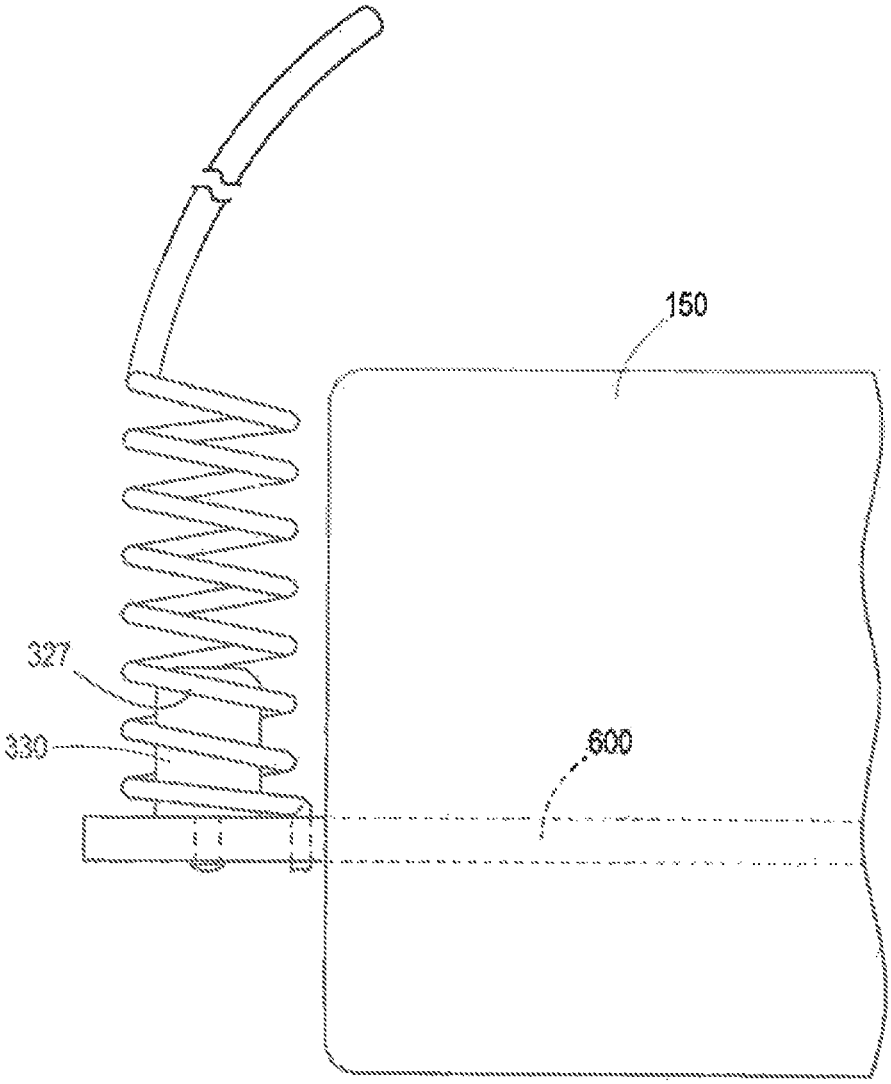

FIG. 6A is a top view of a one piece spring/arm 327 mounted or otherwise interconnected to the frame 600, which is also shown in FIG. 6B. The stress relief pin 330 can be secured to the frame 600 either mechanically or by welding. Any other suitable means for securing pin 330 to the frame 600 can likewise be used. The end of the spring/arm 327 also can be welded or mechanically secured to the frame 600. The spring/arm 327 can also be formed to include short coils to simulate elbow or wrist joints.

Figure 7A:
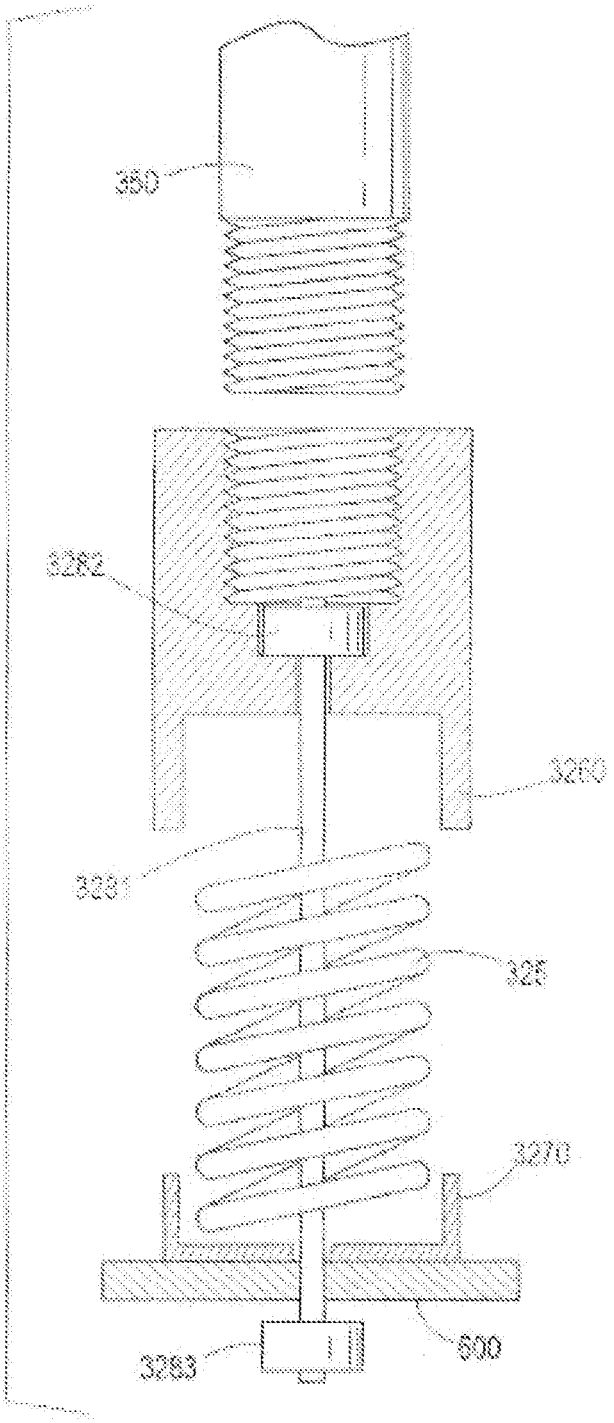
FIGS. 7A and 7B are views of an alternative spring design.
Figure 7B:
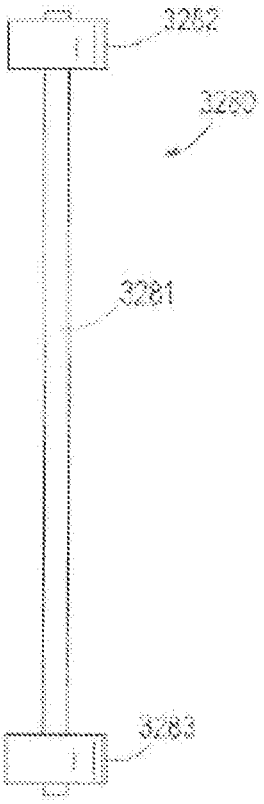

FIGS. 7A and 7B show elevation views of one aspect of the invention wherein the arm spring 325 and the arm stiffener 350 can be mounted to the frame 600 with no welding. The spring 325 is constrained between a retainer 3260 and a retainer 3270. Retainer 3270 is typically interconnected to the frame 600 shown in FIG. 8. In this configuration, the spring 325 is constrained by the walls of retainer 3260 and retainer 3270 relieving stress on the spring 325 welded ends since there is no fixed point relative to the frame 600. A cable assembly 3280 is inserted between retainer 3260 and retainer 3270 to compress spring 325. Cable assembly 3280 includes a cable 3281 and cable terminal 3282 and cable terminal 3283. Decreasing the distance between the cable ends 3282 and 3283 increases the compression forces applied against spring 325. Cable end 3282 typically rests against shoulder 3260 and cable end 3283 against shoulder 3270. The compression applied against spring 325 typically assures the return of spring 325 to a neutral position when the force applied against arm stiffener 350 is released.

Figure 8:
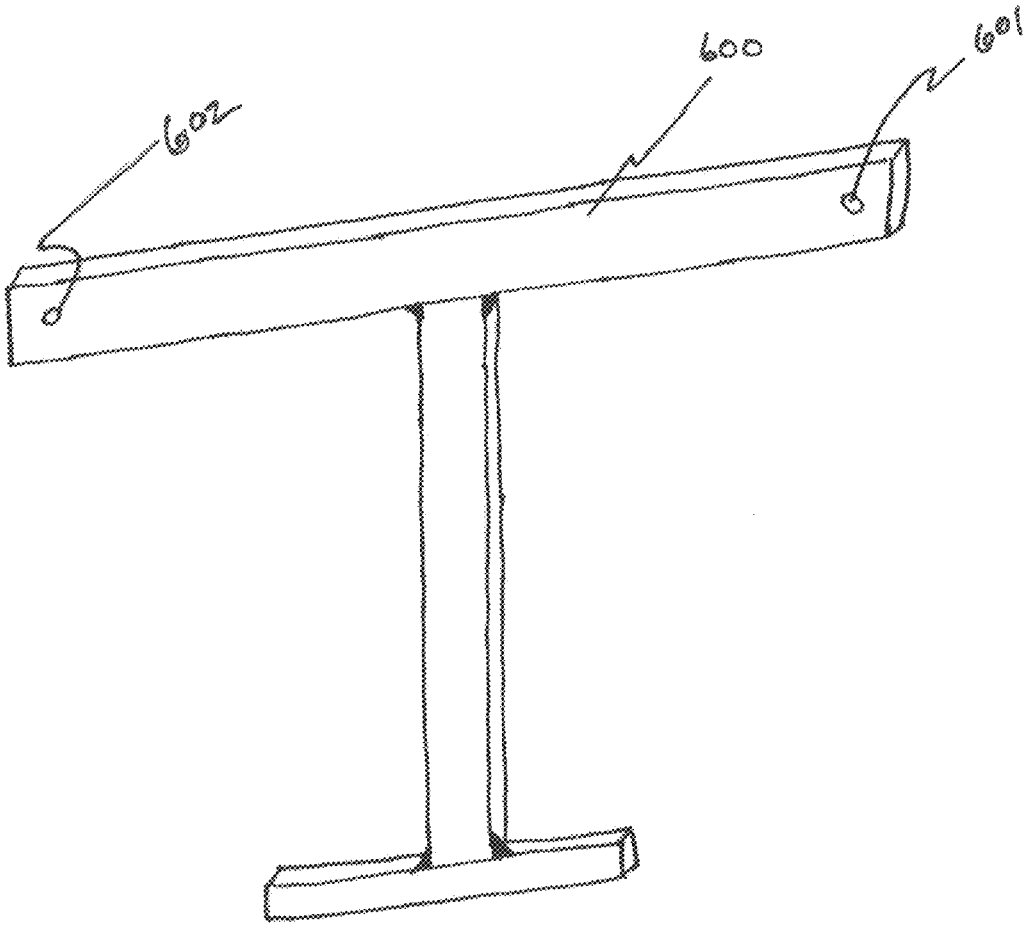
FIG. 8 shows a flat frame assembly.

FIG. 8 shows a flat frame assembly 600 according to another aspect of the present invention. This structure is comprised of three pieces of flat stock steel or aluminum welded together. The top horizontal shoulder (e.g., frame) member typically has one or more holes 601 and 602 drilled to anchor the "stress relief pin" 330 (not shown).

Figure 9A:
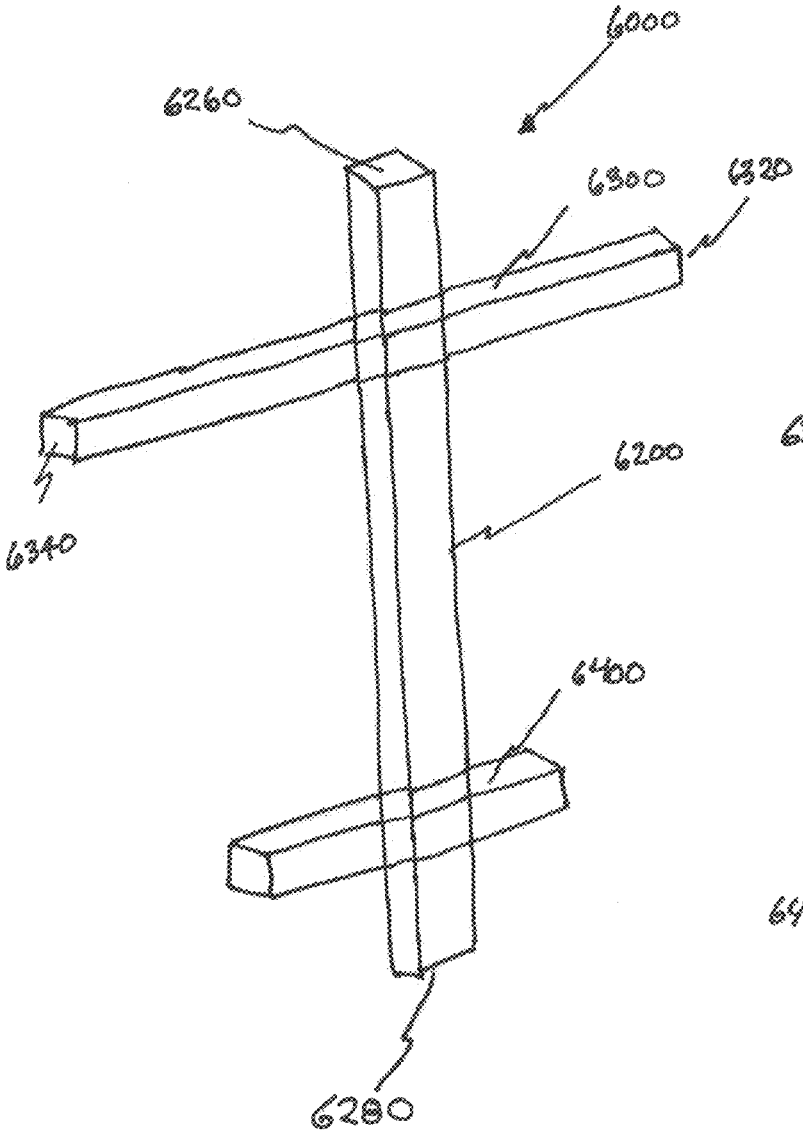
FIGS. 9A and 9B show a tubular frame design.
Figure 9B:
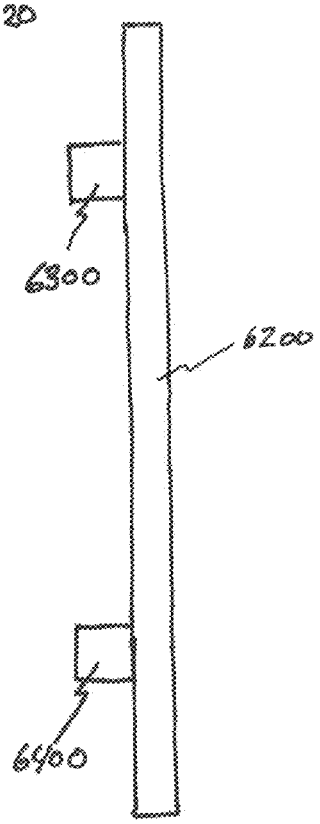

FIGS. 9A and 9B show another aspect of the present invention that includes a tubular frame 6000 constructed of steel, aluminum or composite square tube material. Any other suitable material can likewise be used. The frame assembly 6000 typically has three components: a spine tube 6200 (e.g., vertical frame member), a shoulder tube 6300 (e.g., horizontal frame member), and a hip tube 6400 (e.g., horizontal frame member). The shoulder tube 6300 can be centered and welded perpendicular to the spine tube 6200, and the hip tube 6400 be also be centered and welded perpendicular to the spine tube 6200 and parallel to the shoulder tube 6300. The open ends of the shoulder tube 6300 can provide openings or ports 6320 and 6340 for the insertion of arm plugs as detailed in FIG. 10 and FIG. 11. The shoulder tube 6300 will also be drilled to provide locking holes for the locking pins that are part of the arm plug assemblies shown in FIG. 10 and FIG. 11. The open ends of the spine tube 6200 provide a top port 6260 for a head plug detailed in FIG. 10C, and bottom port 6280 detailed in FIG. 19. The spine tube will also be drilled to provide locking holes for the locking pin that is part of the head plug and the support plug assemblies that are shown in FIG. 10C and FIG. 12.

Figure 10B:
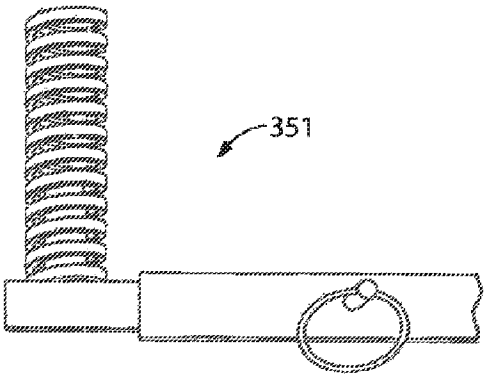
FIGS. 10A, 10B, and 10C show an arm plug assembly.
Figure 10C:
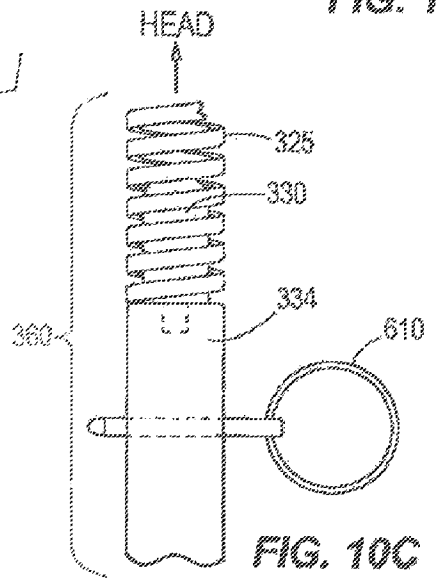
Figure 10A:
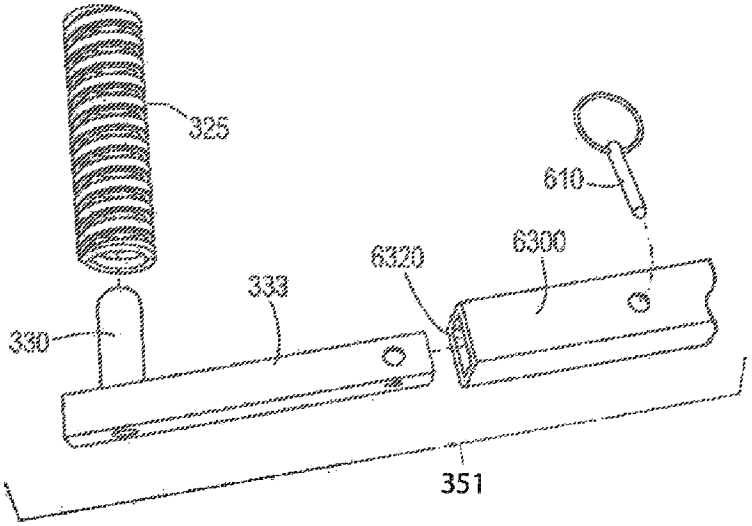

FIGS. 10A and 10B show the components of an arm plug assembly 351 that can include a square plug rod 333 drilled to support a "stress relief pin" 330 that can be welded perpendicular to the square plug rod 333 and a spring 325 that is silicone/bronze welded/brazed perpendicular to square plug rod 333. Any other suitable interconnection between spring 325 and square plug rod 333 can be used. This assembly slides into shoulder tube 6300 at ports 6320 (or 6340 as shown in FIG. 9A) and can be secured in place by locking pin 610 that protrudes through both the shoulder tube 6300 and the square plug rod 333. FIG. 10C shows a head plug assembly 360 where the "stress relief pin" 330 and the spring 325 are welded to the end and in line with the square head plug rod 334. The assembly slides into spine tube 6200 port 6260 (shown in FIG. 9A) and is secured in place by locking pin 610 that protrudes through both the spine tube 6200 and the and the square head plug rod 334.

Figure 11A:
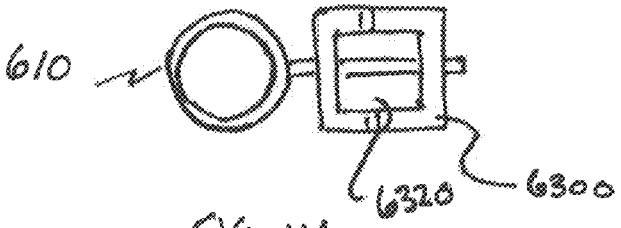
FIGS. 11A, 11B, 11C, and 11D show the shoulder tube and locking pin assembly.
Figure 11B:
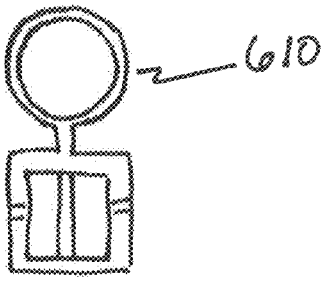
Figure 11C:
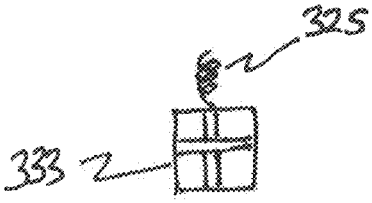
Figure 11D:
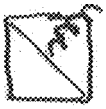

FIG. 11A shows the shoulder tube 6300 and port 6320 with the locking pin 610 inserted horizontally, and FIG. 11B shows shoulder tube 6300 and port 6320 with the locking pine inserted vertically through pre-drilled locking holes. FIG. 11C shows the end of the arm square plug rod 333 with the spring 325 welded to one of the sides. Additionally, as shown in FIG. 11D, the end of the arm square plug rod 333 can be cut at a 45 degree angle and the spring 325 welded to that angled side. The combination of the four orientations of the square-cut arm plug rod 333 in the shoulder tube 6300 and the additional four orientations of the 45 degree angle cut arm plug rod 333 allow the spring 325 and the rest of the arm to be oriented in any of eight positions relative to the torso depending on the specific training requirements.

Figure 12:
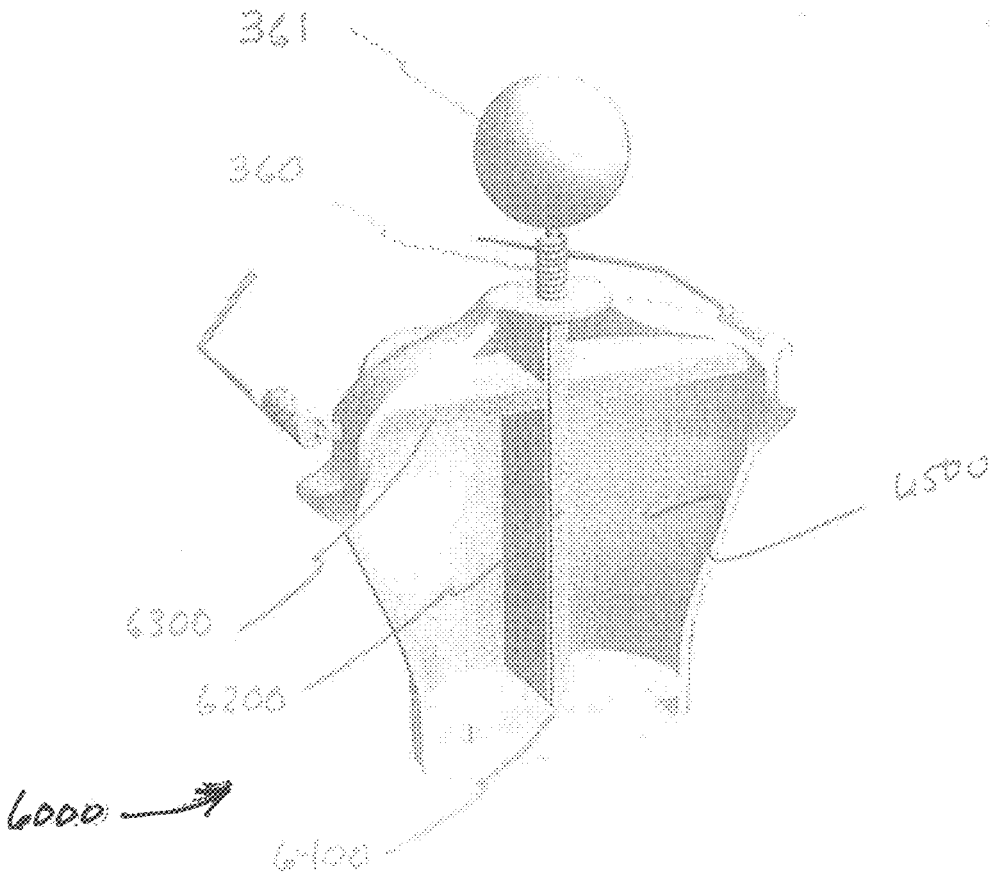
FIG. 12 shows a tubular frame assembly with optional head assembly.

FIG. 12 shows a tubular frame assembly 6000 with spine tube 6200 (e.g., vertical frame member), shoulder tube 6300 (e.g., horizontal frame member) and hip tube 6400 (e.g., horizontal frame member) in a molded body pad 6500. Head plug assembly 360 can be mounted in spine tube port 6260 (see FIG. 9A), and head core 361 can be attached to the head plug assembly 360. Head core 361 can be a plastic or foam ball in certain embodiments.

Figure 13:
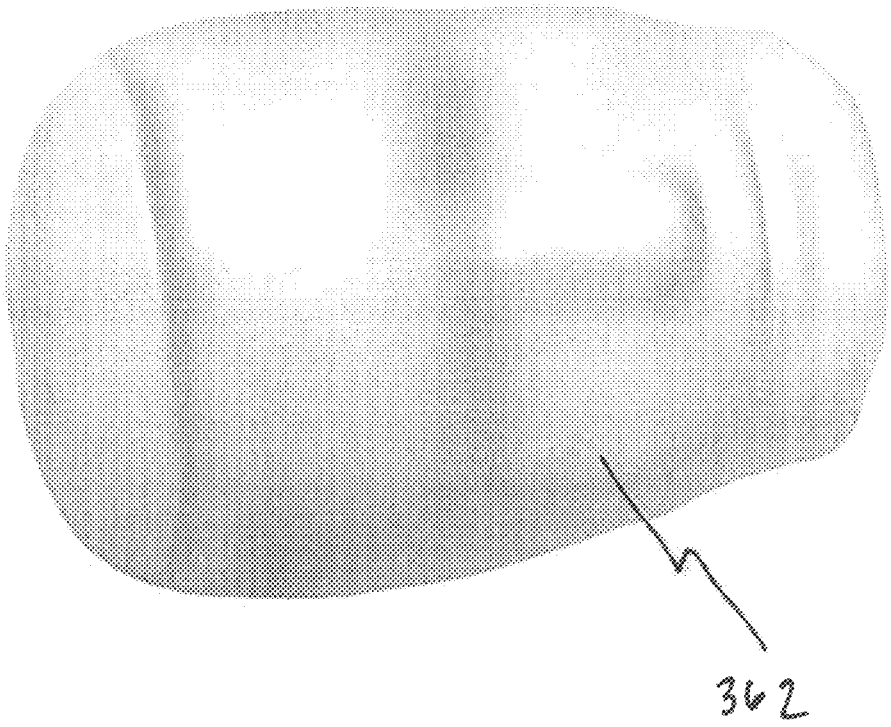
FIG. 13 shows a molded head cover.

FIG. 13 shows a molded head cover 362 that can be secured over head core 361. The molded head cover 362 can be rubber or a molded form of self-skinning foam with some facial detail. Any other suitable material can likewise be used.

Figure 14:
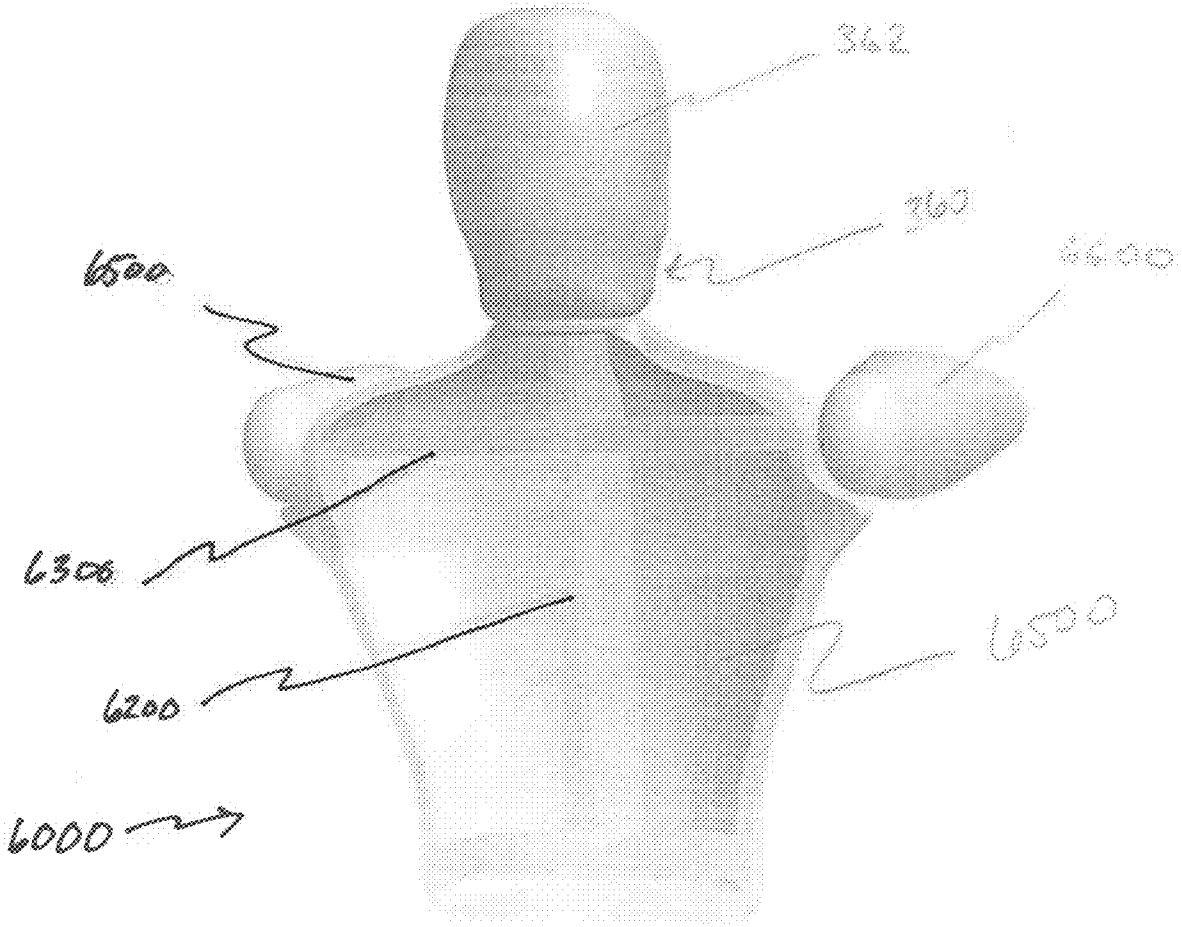
FIG. 14 shows a tubular frame assembly.

FIG. 14 shows a tubular frame assembly 6000 with spine tube 6200, shoulder tube 6300, and hip tube 6400 in a molded body pad 6500. Head plug assembly 360 is mounted in spine tube port 6260 (not shown) and a head cover 362 is disposed over the head core 361. FIG. 14 also shows molded arms that can be molded around the arm stiffeners 250 and 350 (not shown) or around spring/arms 327 (not shown).

Figure 15:
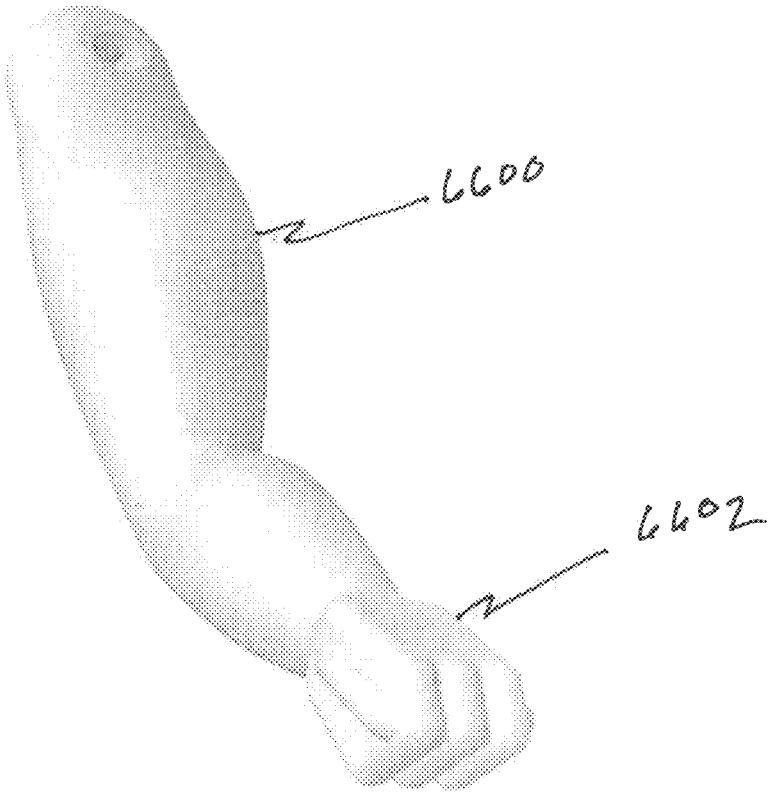
FIG. 15 shows a reversible molded arm.

FIG. 15 shows a reversible molded arm 6600 that can be mounted as either a left or right arm. The arm includes embedded magnets 6602 near the hand palm that can be used to "hold" other training aids such as footballs, knives, guns, MMA weapons, etc., (not shown) to enhance training. The number of magnets in the football, knife, gun or other weapon (not shown) will increase or decrease the magnetic force required to separate the item from the arm/hand 6600. The magnets in the "held items" (not shown) may be embedded in a simulated football or weapon or such magnets may be attached to an actual football or weapon depending on the nature of the training. These or other items can also be attached to the arm/hand using "hook and loop" devices as desired. Such devices can also be attached to arm/hand 6600 in any other suitable manner.

Figure 16B:
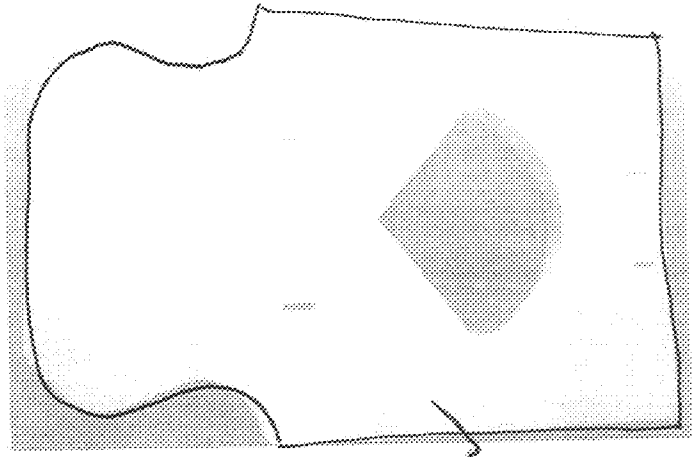
FIGS. 16A, 16B, and 16C show a shoulder pad subassembly.
Figure 16A:
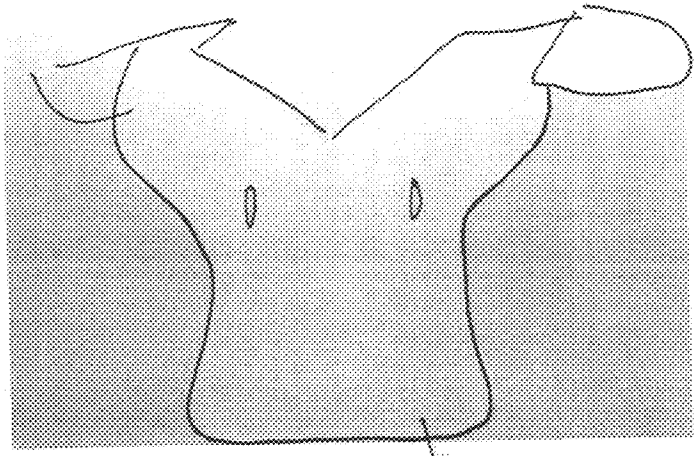
Figure 16C:
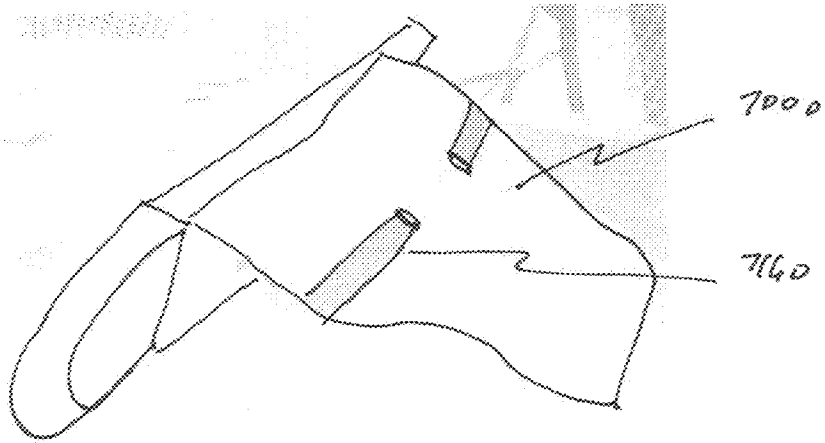
Figure 18B:
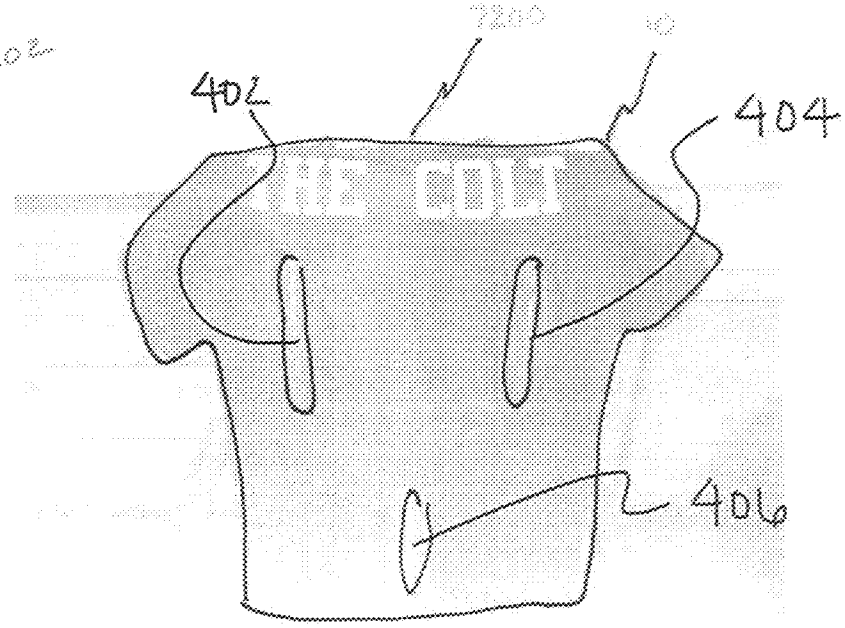
FIGS. 18A and 18B show a target jersey mounted over the shoulder pad subassembly.
Figure 18A:
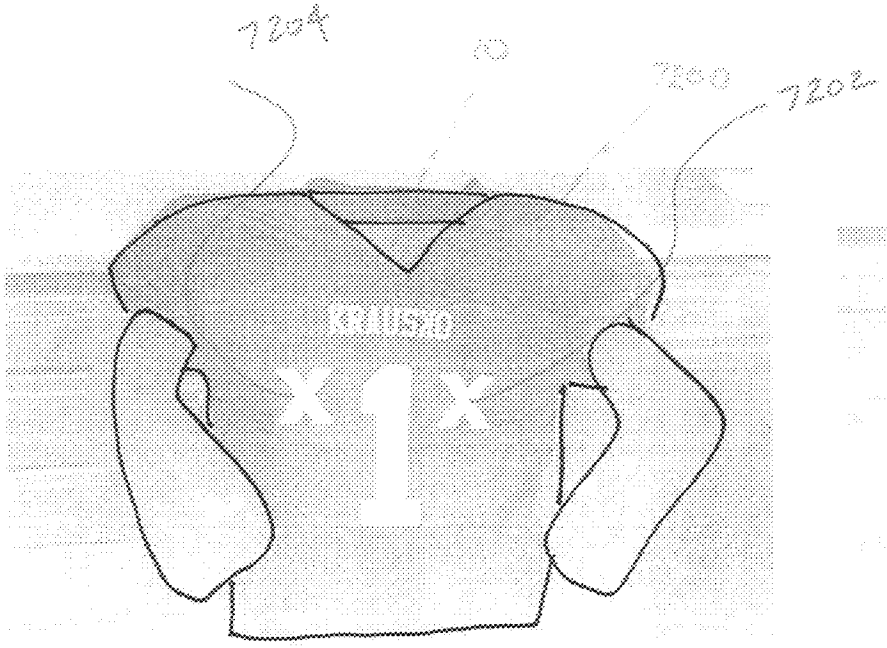

FIGS. 16A, 16B, and 16C show another aspect of the present invention in which a shoulder pad subassembly 7000 is combined with target jersey 7200 (as shown in FIG. 18A) for advanced football training. FIG. 16A shows the hard plastic outer shell 7100 of the assembly, and FIG. 16B shows the foam inner pad 7150 that is adhered to the hard plastic outer shell 7100 to form the shoulder pad subassembly 7000. A nylon or elastic strap 7160 can be used to attach the shoulder pad subassembly 7000 to the blocking pad 10.

Figure 17B:
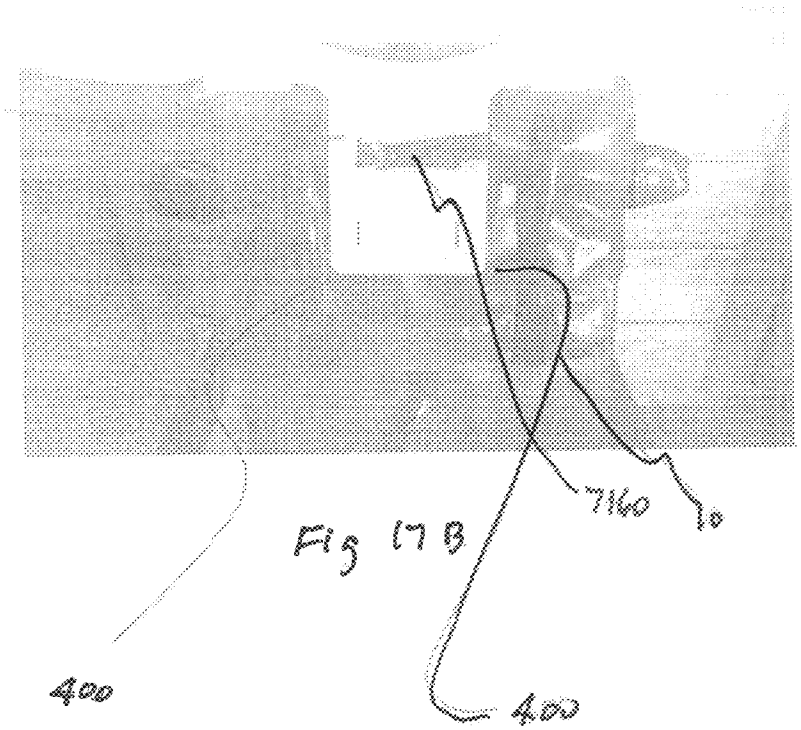
FIGS. 17A and 17B show the shoulder pad subassembly attached to the pad.
Figure 17A:
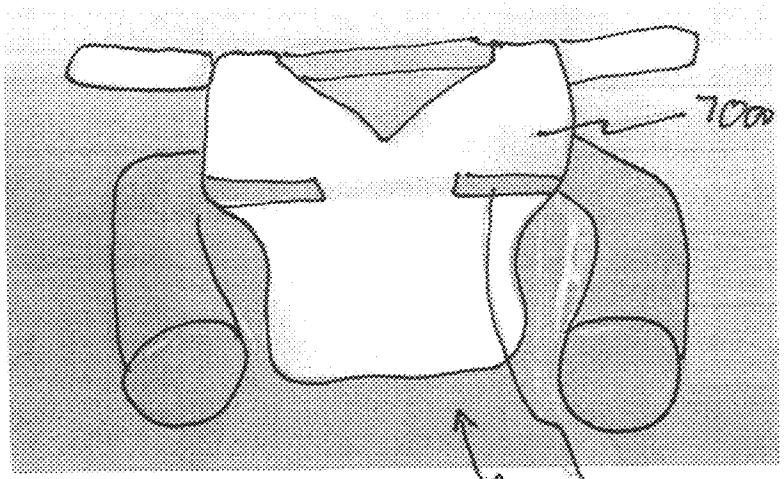

FIG. 17A shows a front elevation of the shoulder pad subassembly 7000 attached to the pad 10 using the strap 7160. FIG. 17B shows a rear elevation of the shoulder pad subassembly 7000 attached to the blocking pad 10 using the strap 7160 routed through the top handles 402 and 404.

FIG. 18A shows a front elevation of a target jersey 7200 mounted over the shoulder pad subassembly 7000 (not shown) attached to the blocking pad 10. The "X"s 7202 and 7204 on the target jersey are targets for hand placement by offensive linemen and additional target markings can be added to the target jersey 7200 as required for advanced football training. FIG. 18B shows a rear elevation of the target jersey 7200 mounted on the blocking pad 10 with access to the device handles 400 to allow complete instructor/coach control of the present invention. The combination of the target jersey 7200 mounted over the shoulder pad subassembly 7000 mounted on the blocking pad 10 provides a realistic simulation of actual opponents and their equipment and there is no restriction on arm 200 or 300 movement due to the target jersey.

Figure 19:
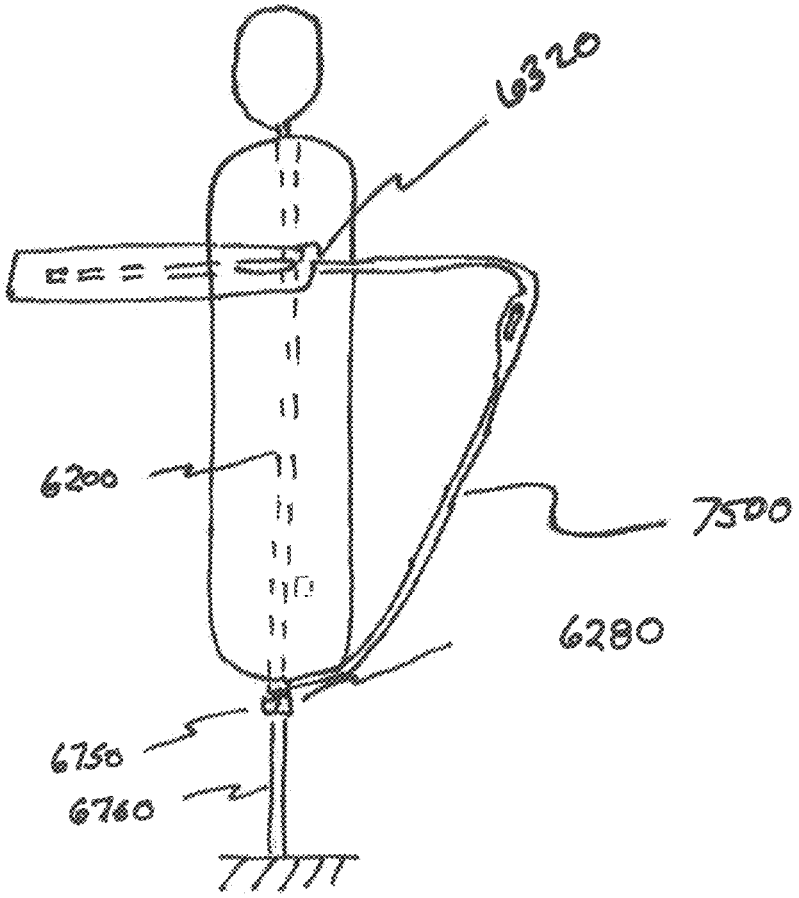
FIG. 19 shows an extended handle included with the base frame.

FIG. 19 shows another aspect of the present invention wherein an extended handle 7500 for use in mixed martial arts ("MMA") training can be used when the instructor needs to hold the device away from his own body, e.g., when training head kicks. The extended handle 7500 typically mounts at ports 6320 and 6340 (see FIG. 9A) at the end of the shoulder tube 6300 and to the bottom port 6280 on the spine tube 6200. A mono-pole support 6760 slides inside a locking collar 6750 that is attached to port 6280. The mono-pole can be FIBERGLAS, a glass fiber reinforced plastic material, aluminum, or a composite and can be equipped with a foot, spike or caster base depending on the desired mobility. With the addition of the appropriate mounting hardware the present invention can also be mounted to walls, football sleds, or other specific purpose training apparatus.

Figure 20B:
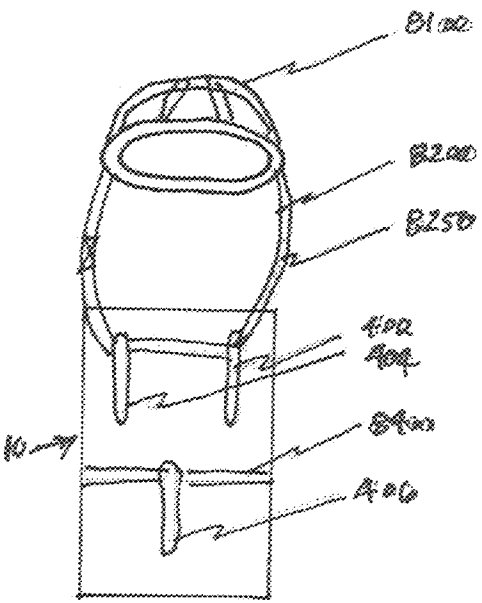
FIG. 20A and FIG. 20B show an embodiment wherein blocking pad can be mounted on a cylinder dummy using a cap/hood assembly.
Figure 20A:
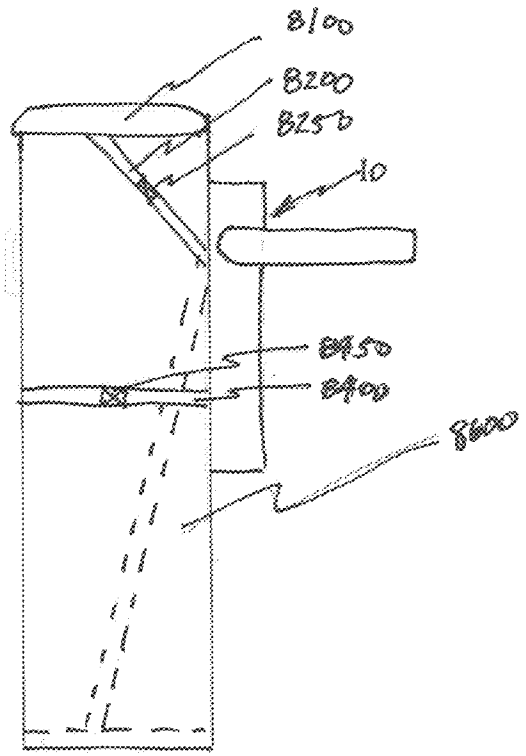

FIGS. 20A and 20B show another aspect of the present invention in which blocking pad 10 can be mounted on a cylinder dummy 8600 using a cap/hood assembly to attach it to the dummy 8600. Typical cylinder dummies are 48" to 72" tall and vary in diameter from 14" to 18" with handles on the rear. FIG. 20A is an elevation view showing the blocking pad 10 secured to a cylinder dummy using a cap 8100 that has straps 820 with an adjustable buckle 8250 to vary strap length and a waist strap 8400 with an adjustable buckle 8450 to vary strap length. The cap 8100 can be constructed of nylon, vinyl or elastic straps or a mesh material, and the adjustable straps 8200 can be nylon, elastic or equivalent material and the adjustable buckles 8250 can be plastic or metal. FIG. 20A also shows an optional use of the mounting hardware to additionally secure the blocking pad 10 to the base of the cylinder dummy. This may be necessary if a football coach chooses to not only teach blocking techniques, but also tackling techniques using the current invention attached to a cylinder dummy. FIG. 20B shows how the blocking pad 10 is secured to the cap 8100 by routing the adjustable straps 8200 through the upper handles 402 and 404. The bottom of the blocking pad 10 is secured to the cylinder dummy by routing the adjustable waist strap 8400 through the lower handle 406. If a coach also uses a cap 8100 to secure the blocking pad 10 to the bottom of the cylinder dummy, the adjustable straps 8200 would also be routed through the upper handles 402 and 404.

Figure 21:
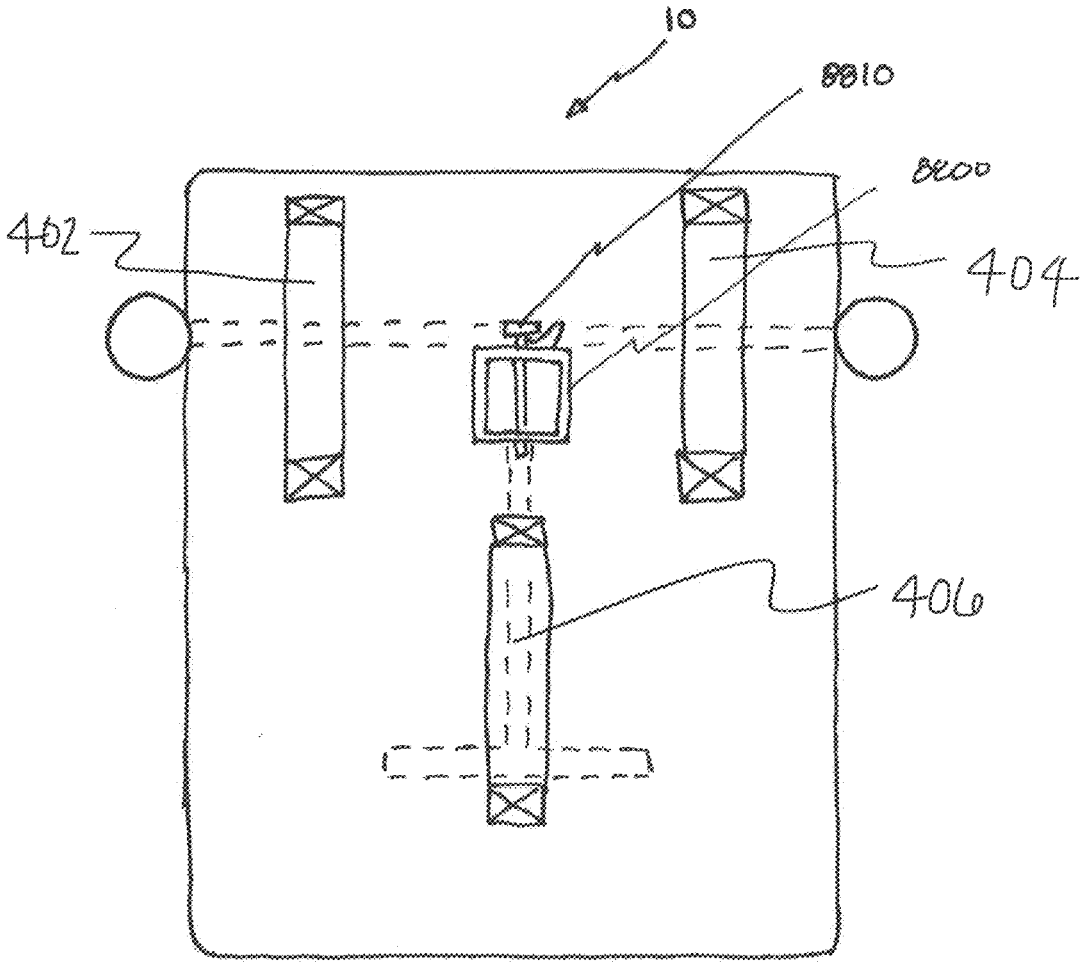
FIG. 21 shows a rear elevation of one aspect of the blocking pad with a rectangular mounting sleeve welded to the frame for use with football sleds or wall mounting.

FIG. 21 shows a rear elevation of one aspect of the blocking pad 10 with a rectangular mounting sleeve 8800 that is welded to the frame of blocking pad 10 and a tethered locking pin 8810.

Figure 22A:
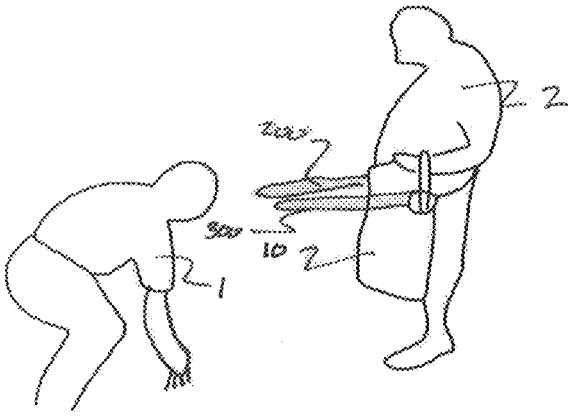
FIGS. 22A-22D show operation of the blocking pad between a player and a coach.
Figure 22B:
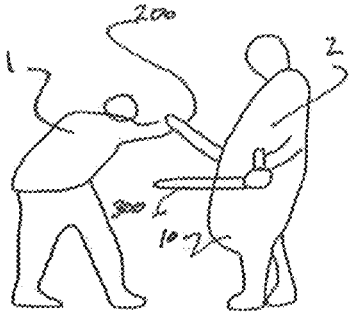
Figure 22C:
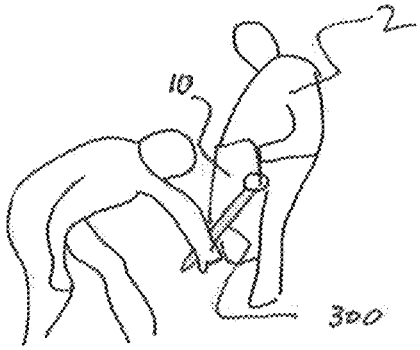
Figure 22D:
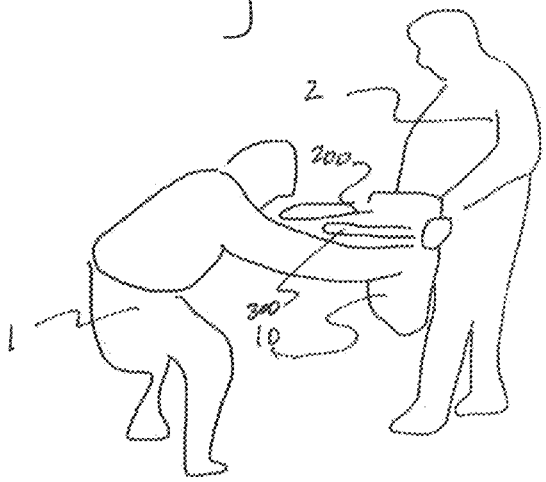

FIGS. 22A-22D show operation of blocking pad 10 between a player 1 and a coach 2 according to one aspect of the invention. FIG. 22A shows a typical starting position for player 1 and coach 2. Arms 200 and 300 of blocking pad 10 are extended in a direction generally perpendicular to the surface of blocking pad 10. FIG. 22B shows a "pushing up" move common for defensive linemen in American football. In such a move, player 1 will use his right hand to engage arm 200 and push arm 200 in an upward direction. The variable resistance of arm 200 creates a realistic simulation for such a maneuver. FIG. 22C shows a "pushing down" move common for defensive linemen in American football. In this move, player 1 will use his left hand to engage arm 300 and apply force to move arm 300 in a downward direction. Again, the variable rotational resistance of arm 300 creates a realistic simulation of such a maneuver. FIG. 22D shows an offensive lineman simulation in which player 1 is an offensive lineman, and coach 2 uses blocking pad 10 to simulate a defensive player with arms 200 and 300 extended outward.

Those skilled in the art will appreciate that numerous modifications and variations may be made to the above disclosed embodiments without departing from the spirit and scope of the present invention.

The invention claimed is:

1. A handheld apparatus for athletic training, comprising:

a rigid frame wherein the rigid frame includes 1) a first frame member extending in a generally horizontal direction and having a first end and a second end; and 2) a second frame member extending in a generally vertical direction and having a first end and a second end, wherein the second frame member is interconnected to the first frame member at a location near a mid-point of the first frame member between the first end and the second end of the first frame member, and wherein the first frame member and second frame member are constructed from a tubular material;

a first arm member having a first end attached to a first lateral edge portion of the rigid frame and having a second end positioned forwardly of the first end, wherein the first arm member comprises a first coil spring having a first end portion, a second end portion, and a coil portion disposed between the first end portion and the second end portion, wherein the first coil spring permits the second end of the first arm member to move relative to the first end of the first arm member;

wherein the first arm member is releasably secured to the first frame member by way of an outer portion of the first end of the first frame member that is releasably attached with a remainder of the first end of the first frame member, and wherein the outer portion is a generally square shape and configured to fit inside an inner portion of the remainder of the first end;

a second arm member having a first end attached to a second lateral edge portion of the rigid frame and having a second end positioned forwardly of the first end, wherein the second arm member comprises a second coil spring having a first end portion, a second end portion, and a coil portion disposed between the first end portion and the second end portion, wherein the second coil spring permits the second end of the second arm member to move relative to the first end of the second arm member;

a pad disposed over the frame; and at least one handle that extends rearwardly with respect to the frame and that is configured to allow a user to manually support the apparatus while the apparatus is being used as a blocking training aid, wherein the outer portion and the remainder of the first end include one or more apertures adapted to receive a pin when the apertures of the outer portion and remainder of the first end are aligned.

2. The apparatus of claim 1, wherein the second arm member is releasably secured to the first frame member by way of an outer portion of the second end of the first frame member that is releasably attached with the remainder of the second end of the first frame member.

3. The apparatus of claim 2, wherein the outer portion is a generally square shape and configured to fit inside an inner portion of the remainder of the second end.

4. The apparatus of claim 3, wherein the outer portion and remainder of the second end include one or more apertures adapted to receive a pin when the apertures of the outer portion and remainder of the second end are aligned.

5. A handheld apparatus for athletic training, comprising:

a rigid frame wherein the rigid frame includes 1) a first frame member extending in a generally horizontal direction and having a first end and a second end; and 2) a second frame member extending in a generally vertical direction and having a first end and a second end, wherein the second frame member is interconnected to the first frame member at a location near a mid-point of the first frame member between the first end and the second end of the first frame member, and further including a support member having a first end, a second end, and a third end, wherein the first end of the support member is interconnected to the first frame member at a position proximate the first end of the first frame member, the second end of the support member is interconnected to the first frame member at a position proximate the second end of the first frame member, and the third end of the support member is interconnected to the second frame member;

a first arm member having a first end attached to a first lateral edge portion of the rigid frame and having a second end positioned forwardly of the first end, wherein the first arm member comprises a first coil spring having a first end portion, a second end portion, and a coil portion disposed between the first end portion and the second end portion, wherein the first coil spring permits the second end of the first arm member to move relative to the first end of the first arm member;

a second arm member having a first end attached to a second lateral edge portion of the rigid frame and having a second end positioned forwardly of the first end, wherein the second arm member comprises a second coil spring having a first end portion, a second end portion, and a coil portion disposed between the first end portion and the second end portion, wherein the second coil spring permits the second end of the second arm member to move relative to the first end of the second arm member;

a pad disposed over the frame; and at least one handle that extends rearwardly with respect to the frame and that is configured to allow a user to manually support the apparatus while the apparatus is being used as a blocking training aid.

* * * * *